US011437731B2

(12) United States Patent
Daniel

(10) Patent No.: US 11,437,731 B2
(45) **Date of Patent: *Sep. 6, 2022**

(54) METHOD AND APPARATUS FOR A PASSIVE RADIATING AND FEED STRUCTURE

(71) Applicant: Metawave Corporation, Palo Alto, CA (US)

(72) Inventor: George Daniel, Palo Alto, CA (US)

(73) Assignee: Metawave Corporation, Carlsbad, CA (US)

( * ) Notice: Subject to any disclaimer, the term of this patent is extended or adjusted under 35 U.S.C. 154(b) by 191 days.

This patent is subject to a terminal disclaimer.

(21) Appl. No.: 16/130,848

(22) Filed: Sep. 13, 2018

(65) Prior Publication Data

US 2019/0081409 A1 Mar. 14, 2019

Related U.S. Application Data

(60) Provisional application No. 62/558,153, filed on Sep. 13, 2017.

(51) Int. Cl.

| | |
|---|---|
| ***H01Q 13/10*** | (2006.01) |
| ***H01Q 21/00*** | (2006.01) |
| ***H01Q 1/36*** | (2006.01) |
| ***H01Q 21/06*** | (2006.01) |
| *H01Q 15/00* | (2006.01) |

(52) U.S. Cl.

CPC ..... *H01Q 21/0012* (2013.01); *H01Q 1/36* (2013.01); *H01Q 21/005* (2013.01); *H01Q 21/061* (2013.01); *H01Q 15/0086* (2013.01)

(58) Field of Classification Search

CPC ..... H01Q 21/00; H01Q 1/36; H01Q 21/005; H01Q 21/061; H01Q 21/0012

USPC ..... 343/770

See application file for complete search history.

(56) References Cited

U.S. PATENT DOCUMENTS

| | | | | |
|---|---|---|---|---|
| 5,724,048 A * | 3/1998 | Remondiere | H01Q 1/288 343/700 MS |
| 6,844,946 B2 * | 1/2005 | Buse | G02B 5/32 359/1 |
| 7,166,797 B1 * | 1/2007 | Dziendziel | G02B 5/208 136/253 |
| 8,319,698 B2 * | 11/2012 | Legay | H01Q 19/104 343/913 |

(Continued)

FOREIGN PATENT DOCUMENTS

DE 2923088 A1 * 12/1980 ..... H04W 16/02

*Primary Examiner* — Trinh V Dinh

(74) *Attorney, Agent, or Firm* — Sandra Lynn Godsey

(57) ABSTRACT

Examples disclosed herein relate to a radiating structure. The radiating structure has a transmission array structure having a plurality of transmission paths, each transmission path having a plurality of slots. The radiating structure also has a radiating array structure of a plurality of radiating elements, with each radiating element corresponding to at least one slot from the plurality of slots, the radiating array structure positioned proximate the transmission array structure. A feed coupling structure is coupled to the transmission array structure and adapted for propagation of a transmission signal to the transmission array structure, the transmission signal radiated through at least one of the plurality of slots and at least one of the plurality of radiating elements.

20 Claims, 13 Drawing Sheets

(56) References Cited

U.S. PATENT DOCUMENTS

| | | | | |
|---|---|---|---|---|
| 9,780,044 | B2 * | 10/2017 | Limb | H01L 23/49894 |
| 10,012,250 | B2 * | 7/2018 | Limb | C03C 27/06 |
| 10,684,354 | B2 * | 6/2020 | Brune | H01Q 3/34 |
| 2005/0057432 | A1 * | 3/2005 | Anderson | H01Q 15/006 343/909 |
| 2007/0001918 | A1 * | 1/2007 | Ebling | H01Q 15/02 343/753 |
| 2009/0066597 | A1 * | 3/2009 | Yang | H01Q 13/22 343/771 |
| 2010/0085272 | A1 * | 4/2010 | Legay | H01Q 19/104 343/913 |
| 2010/0321265 | A1 * | 12/2010 | Yamaguchi | H01Q 21/0043 343/771 |
| 2015/0102973 | A1 * | 4/2015 | Hand | H01Q 15/14 343/836 |
| 2015/0102977 | A1 * | 4/2015 | Lockyear | H01Q 9/0407 343/893 |
| 2015/0318618 | A1 * | 11/2015 | Chen | H01Q 21/005 343/750 |
| 2017/0331186 | A1 * | 11/2017 | Linn | H01Q 3/36 |
| 2018/0241131 | A1 * | 8/2018 | Akselrod | H01Q 15/0066 |
| 2019/0081395 | A1 * | 3/2019 | Daniel | H01Q 21/064 |
| 2019/0148822 | A1 * | 5/2019 | Mobius | H01Q 9/045 343/713 |
| 2020/0335873 | A1 * | 10/2020 | Achour | H01Q 13/08 |
| 2021/0210858 | A1 * | 7/2021 | Pelletti | G01S 7/4056 |

* cited by examiner

METHOD AND APPARATUS FOR A PASSIVE RADIATING AND FEED STRUCTURE

CROSS-REFERENCE TO RELATED APPLICATIONS

This application claims priority to U.S. Provisional Application No. 62/558,153, filed on Sep. 13, 2017, and incorporated herein by reference.

BACKGROUND

As wireless systems and infrastructures are strained, and poised to reach limits, there is a need for systems and designs that meet these challenges. Similarly, from driver-assisted to autonomous vehicles, there is a need for advanced sensing and detection at millimeter wave frequencies and under challenging conditions. Developing devices that operate under these constraints and within these frequencies is challenging.

BRIEF DESCRIPTION OF THE DRAWINGS

The present application may be more fully appreciated in connection with the following detailed description taken in conjunction with the accompanying drawings, which are not drawn to scale, and in which like reference characters refer to like parts throughout, and in which.

DETAILED DESCRIPTION

Methods and apparatuses for a passive radiating and feed structure are disclosed. The passive radiating and feed structure is suitable for many different millimeter wave ("mm-wave") applications and can be deployed in a variety of different environments and configurations. Mm-wave applications are those operating with frequencies between 30 and 300 GHz or a portion thereof, including autonomous driving applications in the 77 GHz range and 5G applications in the 60 GHz range, among others. The passive radiating and feed structure disclosed herein provide antennas with unprecedented capability of generating radio frequency ("RF") waves with improved directivity in both 5G and autonomous driving applications.

It is appreciated that, in the following description, numerous specific details are set forth to provide a thorough understanding of the examples. However, it is appreciated that the examples may be practiced without limitation to these specific details. In other instances, well-known methods and structures may not be described in detail to avoid unnecessarily obscuring the description of the examples. Also, the examples may be used in combination with each other.

Figure 1:
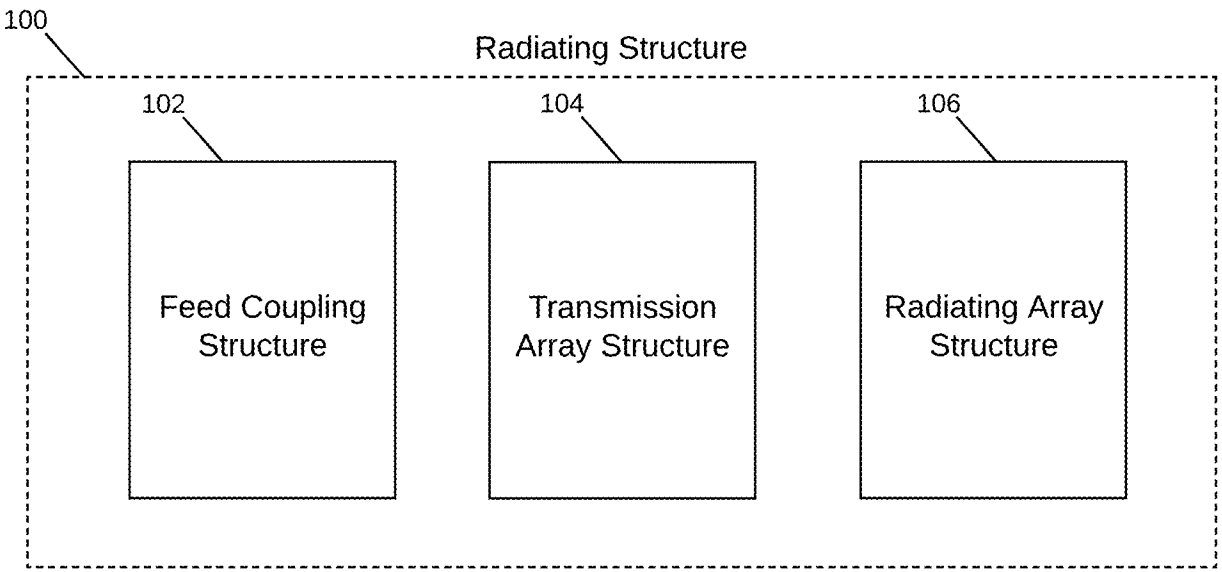
FIG. 1 illustrates a radiating structure or device in accordance with various examples.

FIG. 1 illustrates a radiating structure or device in accordance with various examples. Radiating structure 100 has a feed coupling structure 102, a transmission array structure 104, and a radiating array structure 106. When a transmission signal is provided to the radiating structure 100, such as through circuitry, a coaxial cable, a wave guide, or other type signal feed connector, the signal propagates through the feed coupling structure 102 to the transmission array structure 104 and then to radiating array structure 106 for transmission through the air as a radio frequency ("RF") beam. A variety of signals may be provided to the radiating structure 100 for transmission, such as from a transceiver, transmit circuitry, receive circuitry and so forth. The feed coupling structure 102 in some examples acts to divide received power along a network of transmission lines. The power division may be to support propagation of a received signal for transmission to the radiating array structure 106, such as for transmitting signals over the air, where the radiating array structure 106 acts as a transmit antenna. The power division may also be to support propagation of energy received at the radiating array structure 106 to other parts of the system 100, where the radiating array structure 106 acts as a receive antenna.

In an example application, the radiating structure 100 can be implemented in a radar sensor for use in a driver-assisted or autonomous vehicle. The transmission signal may be a Frequency Modulated Continuous Wave ("FMCW") signal, which is used for radar sensor applications as the transmitted signal is modulated in frequency, or phase. The FMCW signal enables a radar to measure range to a target by measuring timing and phase differences in phase or frequency between the transmitted signal and the received or reflected signal. Within FMCW formats, there are a variety of modulation patterns that may be used within FMCW, including triangular, sawtooth, rectangular and so forth, each having advantages, challenges and application for various purposes. For example, sawtooth modulation may be selected for use when detection involves large distances to a target, i.e., long range. In some examples, the shape of the wave form provides speed and velocity information based on the Doppler shift between signals. This information enables construction of a range-Doppler map to indicate a location and movement of a detected object. As used herein, a target is any object detected by the radar, but may also refer to a specific type of object, e.g., a vehicle, a person, a road sign, and so on.

In another example applications, the radiating structure 100 is applicable in a wireless communication or cellular system, implementing user tracking from a base station, fixed wireless location, and so forth, or function as a wireless relay to provide expanded coverage to users in a wireless network. The transmission signal in cellular communications is a coded signal, such as a cellular modulated Orthogonal Frequency Division Multiplexed ("OFDM") signal. Other types of signals may also be used with radiating structure 100, depending on the desired application.

Figure 2:
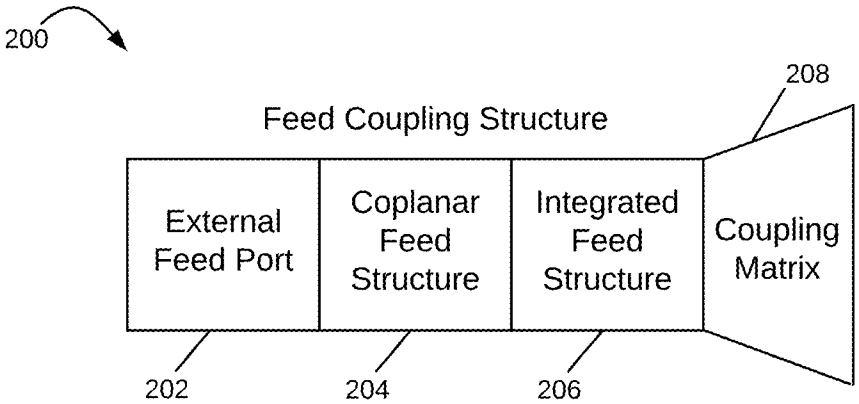
FIG. 2 is a schematic diagram of an example feed coupling structure for use in a radiating structure as in FIG. 1.

Each of the structures 102-106 is described in more detail hereinbelow. FIG. 2 is a schematic diagram of an example feed coupling structure 200 for use in the radiating structure 100 of FIG. 1. Feed coupling structure 200 includes an external feed port 202 adapted to receive a transmission signal such as by way of a coaxial cable or other signal source. The external feed port 202 interfaces with coplanar feed structure 204 for propagation of the received transmission signal. The coplanar feed structure 204 then interfaces with the integrated feed structure 206, which is integrated within a substrate, wherein the received transmission signal propagates through the substrate to the coupling matrix 208. The integrated feed structure 206 includes transmission paths along the substrate through which the transmission signal propagates, and may include vias through the substrate to form waveguide structures in order to maintain the transmission signal within the transmission paths of the integrated feed structure 206. Such vias prevent the transmission signal from significantly propagating out of the integrated feed structure 206. The coupling matrix 208 couples the integrated feed structure 206 with the transmission array structure 104 of FIG. 1; the coupling matrix 208 is configured to distribute a received transmission signal to a plurality of transmission paths of the transmission array structure 104. The coupling matrix 208 divides the energy of the transmission signal, such that each of the transmission paths receives a substantially equal portion of the signal. In some examples, this distribution may not be equally divided, such as to taper the transmissions at certain points of the transmission array structure 104, or antenna.

Figure 3:
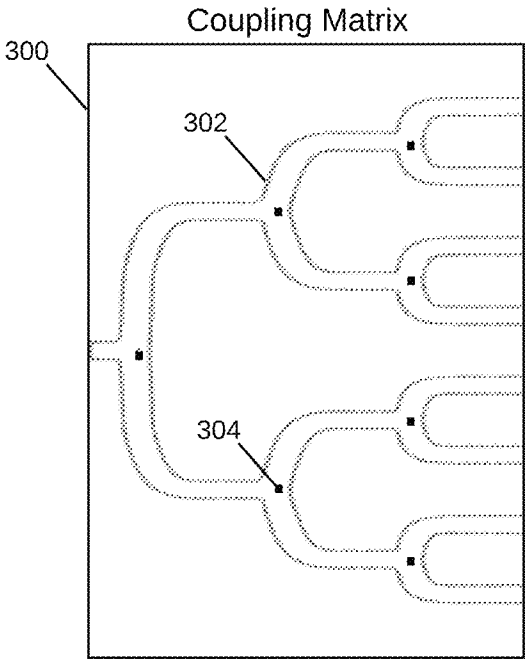
FIG. 3 illustrates an example coupling matrix for use in a feed coupling structure as in FIG. 2.

An example coupling matrix 208 for use in the feed coupling structure 200 is illustrated in FIG. 3. The coupling matrix 300 is a type of a power divider circuit such that it takes an input signal and divides it through a network of coupling paths or transmission lines 302 that are formed from vias in the substrate. These vias extend through a second conductive layer in the substrate and are lined, or plated, with conductive material. The coupling paths 302 act to distribute the received transmission signal to the transmission array structure 104. Each coupling path 302 may have similar dimensions; however, the size of the paths may be configured to achieve a desired transmission and/or radiation result. In various examples, the coupling matrix 300 is designed to be impedance-matched, such that the impedances at each end of a transmission line/coupling path matches the characteristic impedance of the line itself. Matching vias such as matching via 304 are incorporated into the coupling paths to improve impedance matching. In the illustrated example, there are eight (8) coupling paths, corresponding to 8 transmission array elements. Alternate examples may use traditional or other waveguide structures or transmission signal guide structures.

Figure 4:
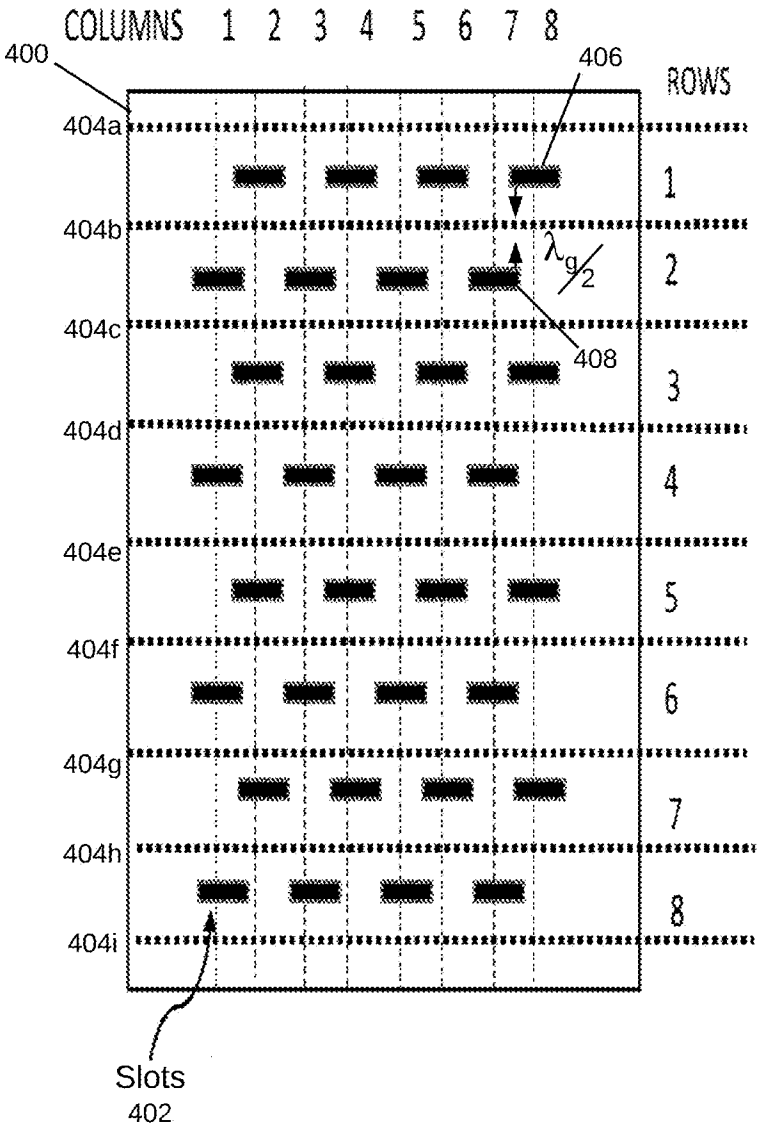
FIG. 4 is a schematic diagram of an example transmission array structure for use in a radiating structure as in FIG. 1.

Referring now to FIG. 4, a schematic diagram of an example transmission array structure for use in the radiating structure of FIG. 1 is described. The transmission array structure 400 is made up of an array of transmission paths bounded by a set of vias that maintain the transmission signal therein. The vias are configured as holes that pass through the substrate to a conductive layer or reference layer (not shown). The vias are lined with a conductive material.

The transmission array structure 400, as illustrated in FIG. 4, is defined by a number of rows, r, and a number of columns, c. The rows correspond to each of the transmission paths. For the reader's comprehension, a graph is superimposed over the transmission array 400 to provide the approximate position of each element. Each of the eight (8) rows of the transmission array structure 400 has a corresponding row in the radiating array structure 106 of FIG. 1. In the illustrated example, the horizontal lines represent the vias 404 formed in the substrate to create paths for the transmission signal in each row. The vias are spaced so as to maintain the transmission signal within the path of each row. As illustrated, via lines 404*a* and 404*b* bound the transmission signal within row 1.

Each row of the transmission array 400 has multiple discontinuities, slots or openings 402, formed into the substrate, through which the propagated signal will radiate. As illustrated, there are multiple slots 402, such as the four (4) slots illustrated per row; see slot 402 of row 8. In this illustration there are 4 slots per row, wherein the slots 402 of adjacent rows are offset from one another by one column length. In this configuration, the slots 402 correspond positionally to the radiating elements of the radiating array structure 106 of FIG. 1 and described below with reference to FIGS. 9-10.

The propagating signal radiates through a slot 402 to a proximate radiating element, from which the signal is transmitted into the environment. The slots in the transmission array structure 400 are formed lengthwise throughout each row. Each row can be thought of as a waveguide. The effective waveguide structure is bounded by conductive vias along its length and grounded at its end. The dimensions are designed such that the waveguide end is an equivalent open circuit, avoiding signal reflections. The distance between the center of a slot in a row of transmission array structure 400 and the center of an adjacent equidistant slot is shown as $\lambda_g/2$, where $\lambda_g$ is the guide wavelength.

Figure 5:
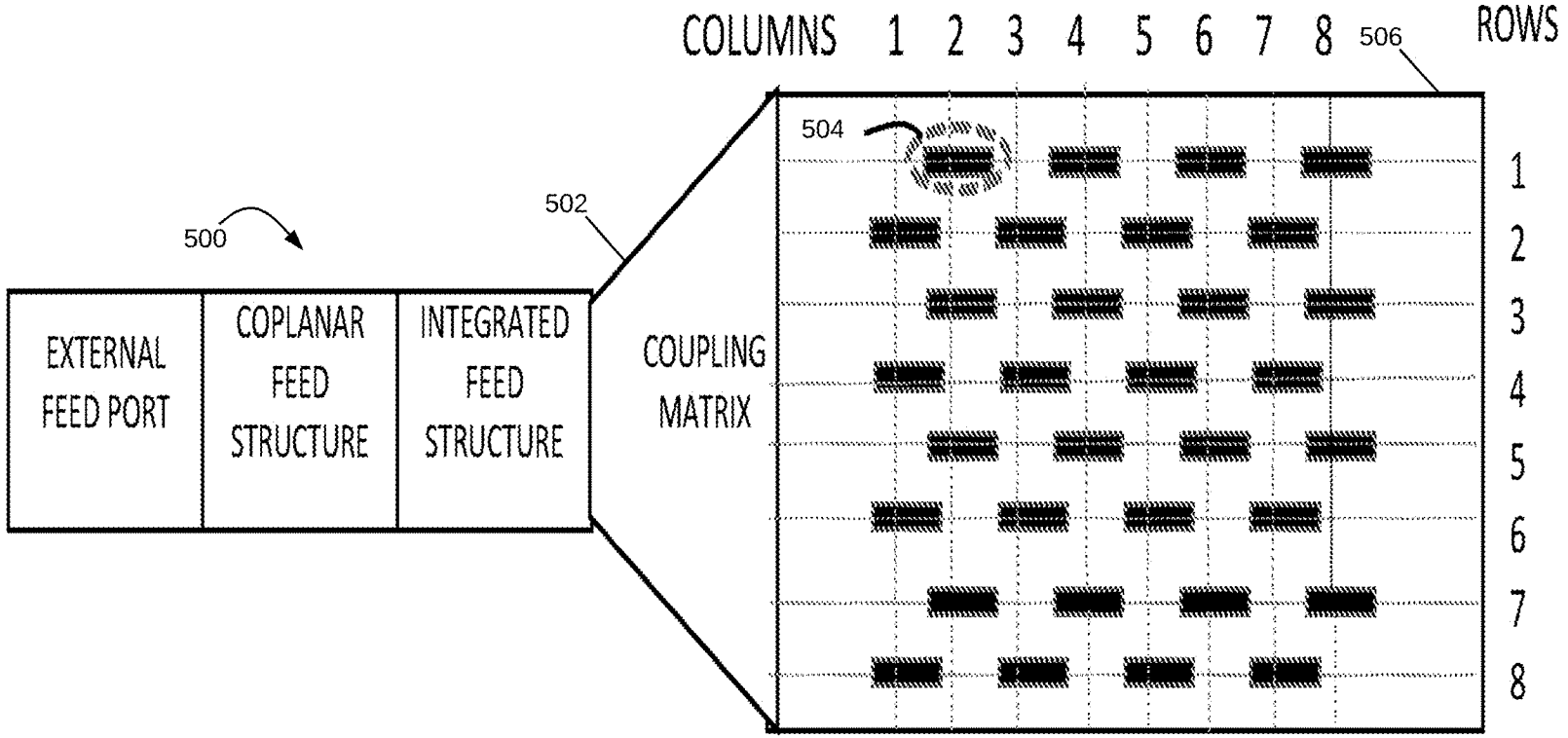
FIG. 5 illustrates a feed coupling structure as in FIG. 2 coupled to a transmission array structure as in FIG. 4 in accordance with various examples.

In another example, a transmission array structure 506 is connected to a coupling structure 500 as shown in FIG. 5. Coupling structure 500, or feed coupling structure, has coupling matrix 502, which can be implemented as the example coupling matrix 300 of FIG. 3 with eight (8) coupling paths, each coupling path providing a signal to a corresponding row of the transmission array 506. The signal radiates through the slots in the rows, e.g., slot 504, to a corresponding radiating element of a radiating array structure, e.g., radiating array structure 106 of FIG. 1.

Figure 6:
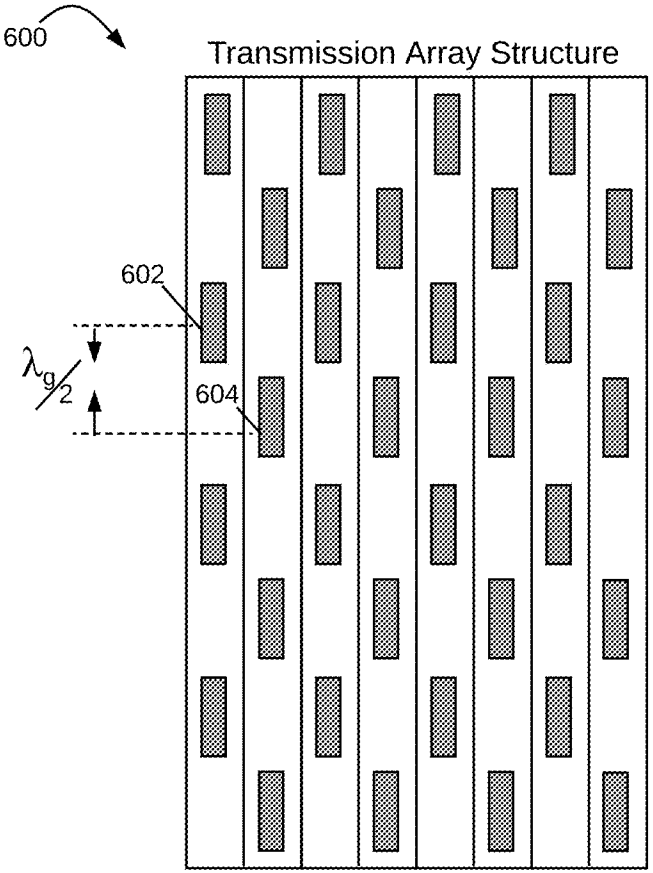
FIGS. 6-8 illustrates other examples of a transmission array structure for use in a radiating structure as in FIG. 1.

Another example transmission array structure is illustrated in FIG. 6. Transmission array structure 600 has a perpendicular orientation with respect to transmission array structure 400 of FIG. 4, wherein slots are positioned along columns rather than rows. In this illustrated example, a feed coupling structure would also have a vertical orientation, with coupling paths or transmission lines of its coupling matrix supporting the propagation of transmitting signals to the columns rather than the rows of transmission array structure 600. In this example, the center of adjacent slots of transmission array structure 600, e.g., slots 602-604, are distanced by $\lambda_g/2$, where $\lambda_g$ is the guide wavelength of a waveguide along a column of transmission array structure 600.

Figure 7:
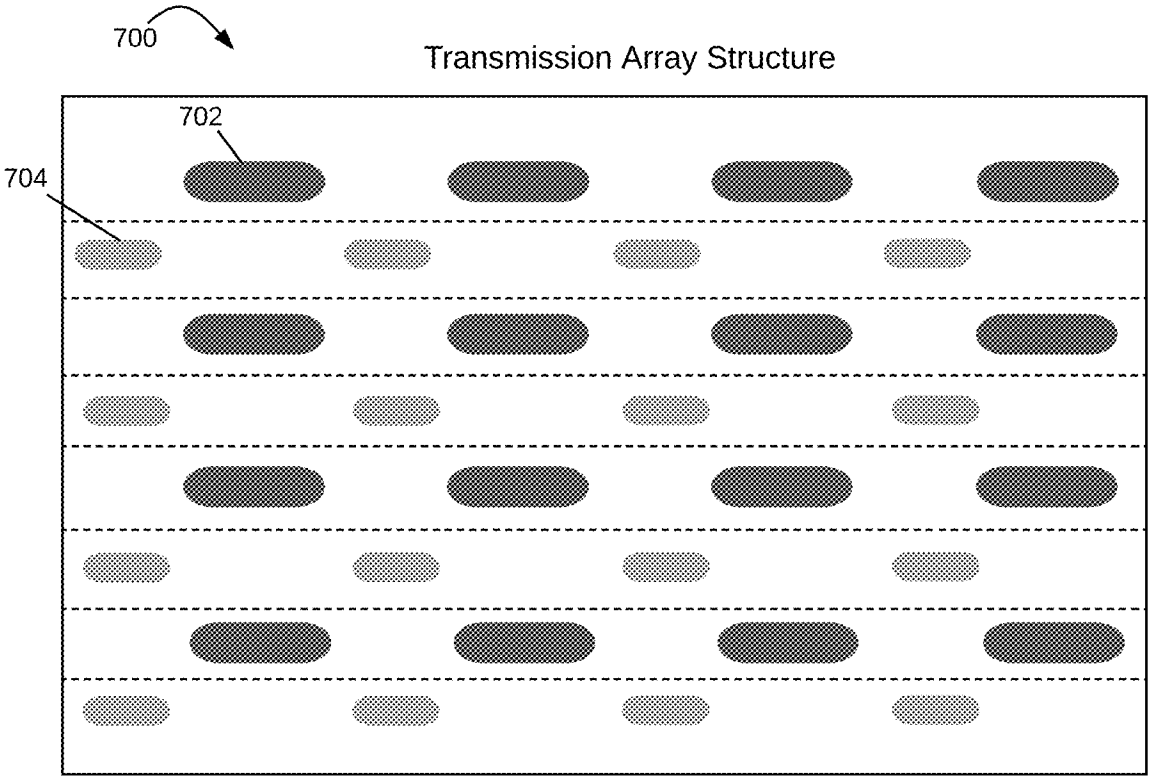
Figure 8:
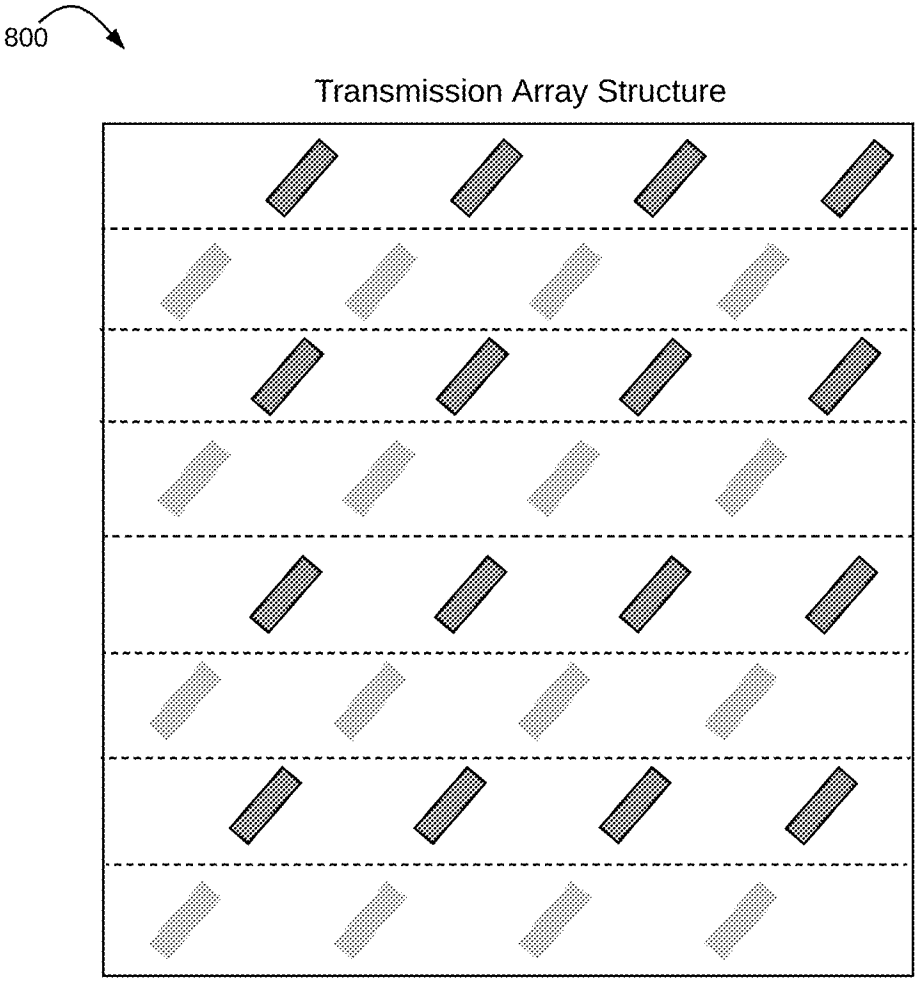

It is appreciated that the slots in transmission array structures 400 and 600 are shown to have a rectangular shape for illustration purposes only. Slots may be designed to have different shapes, orientations and be of different sizes, depending on the desired application. An example of such a transmission array is shown in FIG. 7, where the slots have an oval shape and different sizes, with slots in a row having one size, e.g., slot 702, and the slots in an adjacent row, e.g., slot 704, having another size. Slots may be smaller at the edges of the transmission array structure 700 to taper a transmission signal. Further, slots may also be oriented at an angle with respect to a row of a transmission array structure, as shown in FIG. 8, with transmission array structure 800. The position, shapes, configuration and so forth are destined to achieve a desired result. These form the radiation patterns transmitted and received and affect the gain, side lobes and other characteristics of EM signals.

Figure 9:
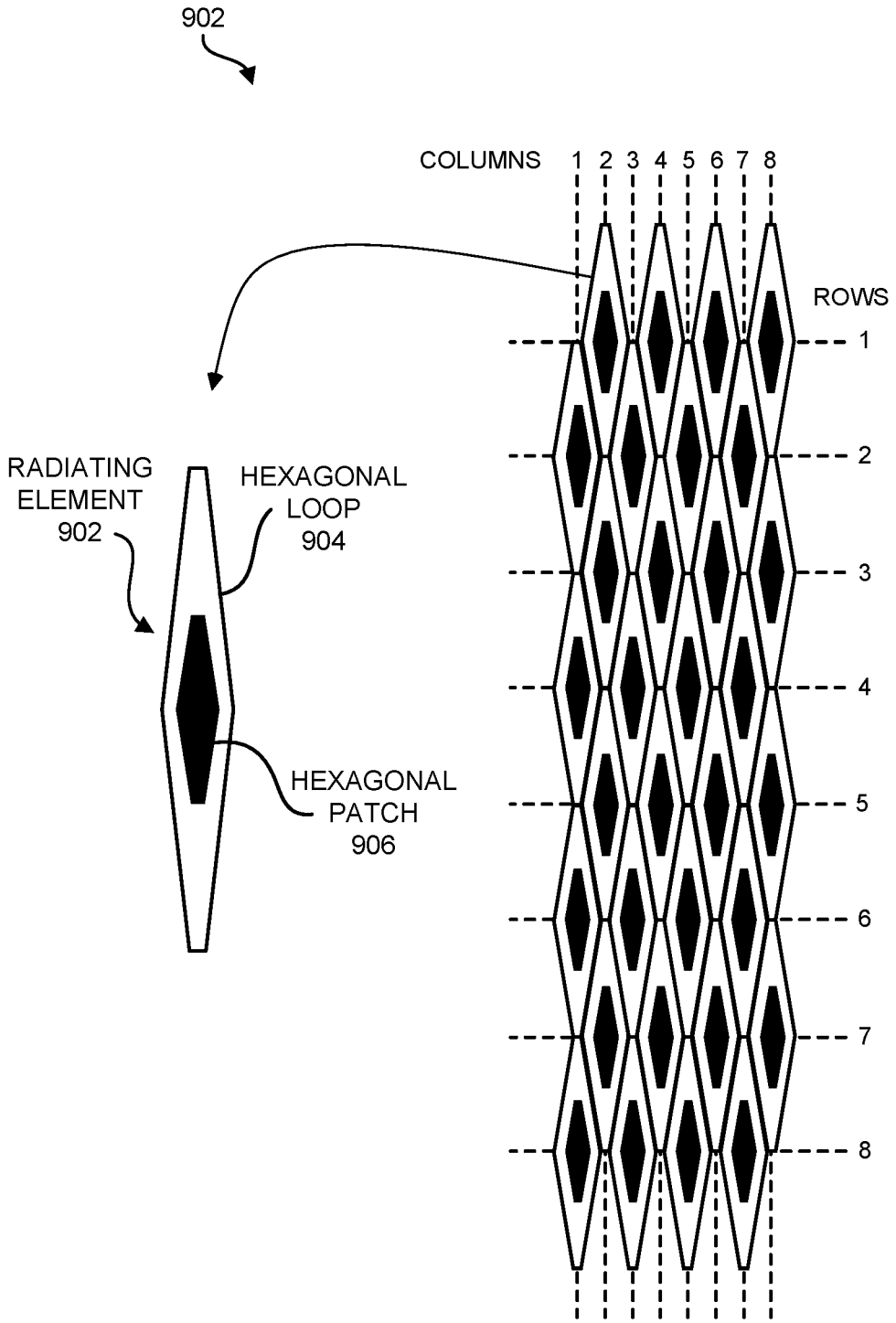
FIG. 9 is a schematic diagram of a radiating array structure for use in a radiating structure as in FIG. 1 in accordance with various examples.

Attention is now directed to FIG. 9, which shows a radiating array structure for use in the radiating structure of FIG. 1 in accordance with various examples. Radiating array structure 900 includes multiple individual elements, e.g., radiating element 902, to form a lattice structure of hexagonal elements. The radiating array structure 900 is designed to operate in coordination with the transmission array structure 104, wherein individual radiating elements correspond to individual slots within the transmission array structure 104. Each hexagonal element is designed to radiate at the transmission signal frequency, wherein each hexagonal element is the same size and shape. Each slot in a transmission array structure and corresponding radiating element in a radiating array structure have a fixed relationship, wherein the center of each slot corresponds to the center of the radiating patch of a radiating element. In this way, the radiating structure 900 provides a wireless signal, such as a radar signal.

As illustrated, the radiating elements' hexagonal shape provides design flexibility for a densely packed array. Each radiating element has an outer geometric shape, referred to herein as a hexagonal conductive loop, e.g., loop 904, and an inner geometric shape that is referred to as a hexagonal conductive patch, e.g., patch 906. This configuration is repeated to form a densely packed lattice. Note that although illustrated as having a hexagonal shape, a radiating element may be of another shape, e.g., circular, rectangular, etc., depending on the application. A variety of sizes, configurations and designs may be implemented.

In various examples, a radiating element is a metamaterial element. A metamaterial is an artificially structured element used to control and manipulate physical phenomena, such as the electromagnetic ("EM") properties of a signal including its amplitude, phase, and wavelength. Metamaterial structures behave as derived from inherent properties of their constituent materials, as well as from the geometrical arrangement of these materials with size and spacing that are much smaller relative to the scale of spatial variation of typical applications. A metamaterial is not a tangible new material, but rather is a geometric design of known materials, such as conductors, that behave in a specific way. A metamaterial element may be composed of multiple microstrips, gaps, patches, vias, and so forth, having a behavior that is the equivalent to a reactance element, such as a combination of series capacitors and shunt inductors. Various configurations, shapes, designs and dimensions may be used to implement specific designs and meet specific constraints. In some examples, the number of dimensional degrees of freedom determines the device characteristics, wherein a device having a number of edges and discontinuities may model a specific-type of electrical circuit and behave in a similar manner. In this way, a radiating element radiates according to its configuration. Changes to the design parameters of a radiating element result in changes to its radiation pattern. Where the radiation pattern is changed to achieve a phase change or phase shift, the resultant structure is a powerful antenna or radar, as small changes to the radiating element can result in large changes to the beamform.

In various examples, a metamaterial radiating element has some unique properties. These properties may include a negative permittivity and permeability resulting in a negative refractive index; these structures are commonly referred to as left-handed materials ("LHM"). The use of LHM enables behavior not achieved in classical structures and materials, including interesting effects that may be observed in the propagation of electromagnetic waves, or transmission signals. Metamaterials can be used for several interesting devices in microwave and terahertz engineering such as antennas, sensors, matching networks, and reflectors, such as in telecommunications, automotive and vehicular, robotic, biomedical, satellite and other applications. For antennas, metamaterials may be built at scales much smaller than the wavelengths of transmission signals radiated by the metamaterial. Metamaterial properties come from the engineered and designed structures rather than from the base material forming the structures. Precise shape, dimensions, geometry, size, orientation, arrangement and so forth result in the smart properties capable of manipulating EM waves by blocking, absorbing, enhancing, or bending waves.

Figure 10:
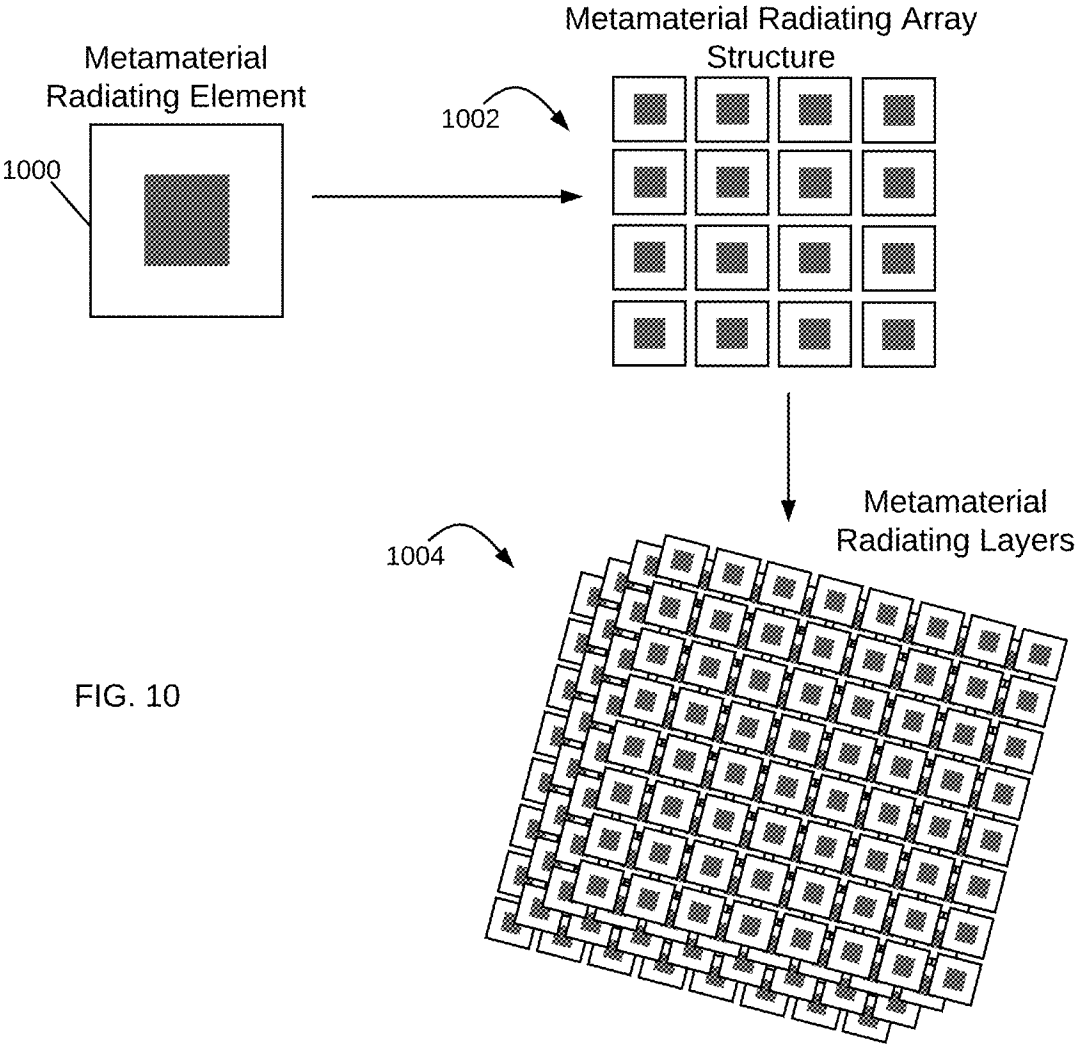
FIG. 10 is a schematic diagram of a metamaterial radiating element, a single layer radiating array structure and a multi-layer radiating array structure in accordance with various examples.

In FIG. 10, a metamaterial radiating element 1000 is shown to have a rectangular shape. The metamaterial radiating element 1000 can be arranged in a radiating array structure 1002 much like the radiating array structure 900 in FIG. 9 and the radiating array structure 106 in FIG. 1. Note that in structure 1002, the radiating elements are spaced apart by a distance that is determined based on the desired radiation pattern and beam characteristics. Note also that a radiating array structure may be implemented as a layer in a multi-layer radiating array, such as metamaterial radiating layers 1004 having 4 layers of 8×8 radiating arrays. The number of elements in an array, the shape of the elements, the spacing between the elements, and the number of layers can all be designed to achieve a desired radiation pattern and performance in a radiating structure.

Figure 11:
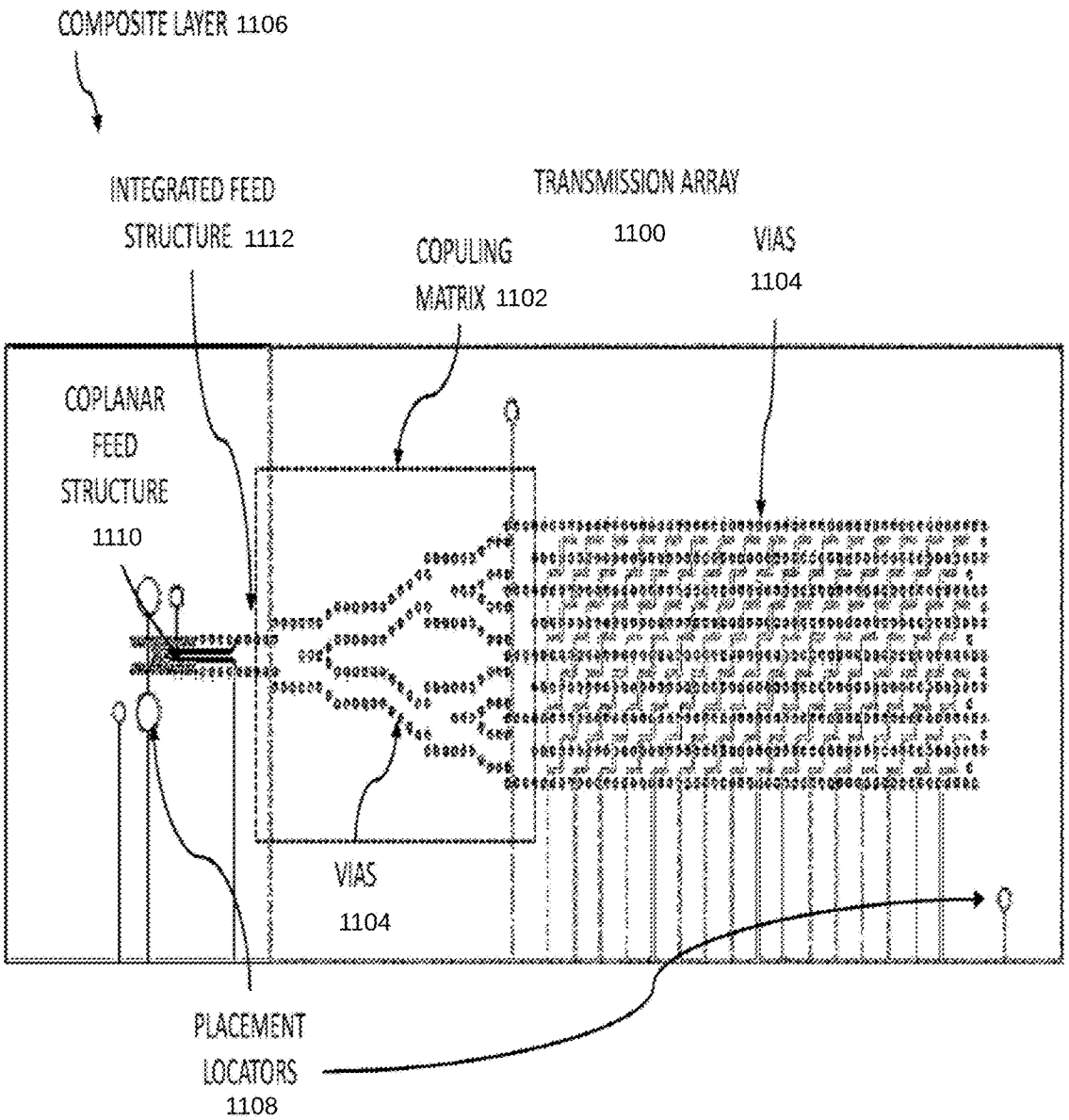
FIG. 11 illustrates a combination of the layout of a portion of a radiating structure on a composite layer in accordance with various examples.

Attention is now directed to FIG. 11, which illustrates paths for propagation of signals from input to the coplanar feed structure 1110 to transmission array structure 1100. Intervening structures and layers are provided as an example, but are not meant to limit the designs and configurations of the present invention. The transmission array structure 1100 may be formed in a variety of builds, which may use multiple layers, boards, and so forth. Vias are used to form waveguides in the examples herein, however, alternate methods may be implemented to maintain a waveguide-like structure to direct transmission signals.

FIG. 11 illustrates a combination of the layout of a portion of a radiating structure on a composite layer, wherein the layout design is provided for clarity and understanding of the reader. As illustrated, the transmission paths of the transmission array structure 1100 are defined by the via paths bordering each row. The coupling matrix 1102 divides the transmission paths by the configuration of vias 1104 as illustrated. These vias 1104 are also holes through the substrate that are plated or lined with a conductive material, to connect two individual conductive portions of the composite layer 1106. This layout may be fabricated as a single component having multiple layers and with placement locators 1108, or holes, to position a radiating array structure correctly within the composite layer 1106. As discussed hereinabove, each of the slots in the transmission array structure 1100 is to be placed proximate a corresponding one of the radiating elements of the radiating array structure, and such proximity may be below or underneath from the illustrated perspective. Also illustrated are the coplanar feed structure 1110 and the integrated feed structure 1112 that provide the transmission signal to the transmission array structure 1100. The signal is radiated through the slots to the radiating elements in a radiating array structure positioned above the transmission array structure 1100. The radiating array structure (not shown) can be a single layer or multiple layers as described above.

Figure 12:
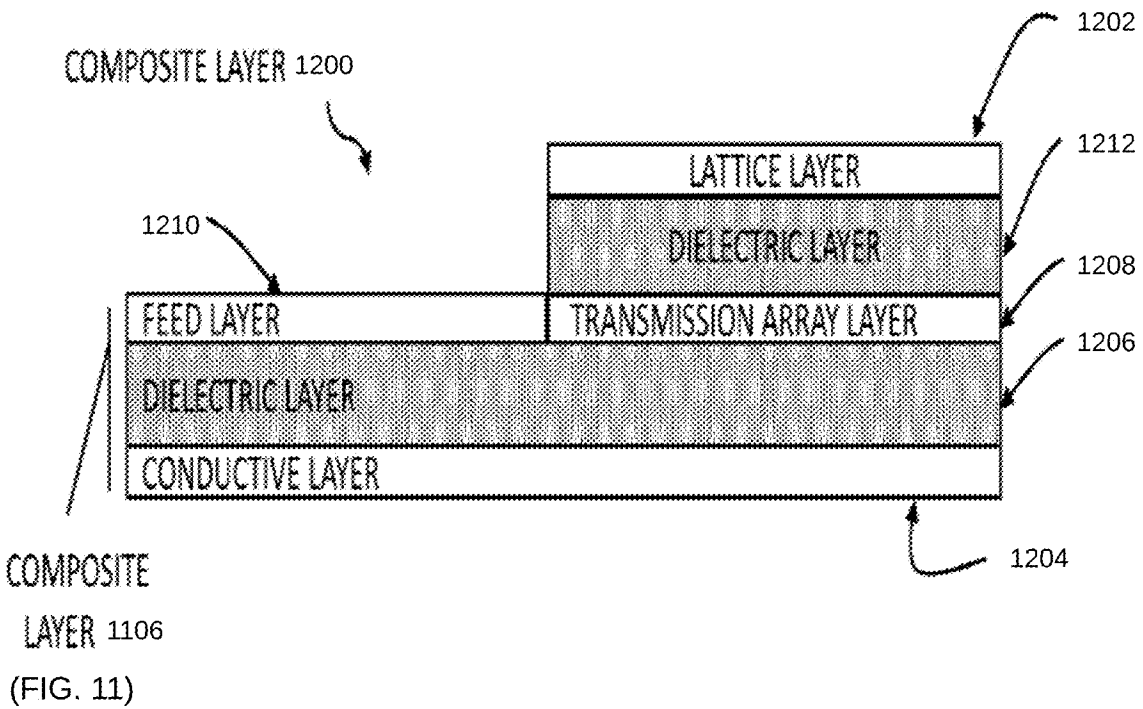
FIG. 12 illustrates a side view of a composite layer in accordance with various examples.

FIG. 12 illustrates a side view of a composite layer 1200, having the radiating array structure 1202 appended to the composite layer 1106. The conductive layer 1204 is coupled to a dielectric layer 1206. The components illustrated in FIG. 11 are formed in layer 1208 and are defined by a feed portion 1210 and the transmission array structure 1100 portion. The feed portion 1210 includes the external feed port 202, the coplanar feed structure 204, the integrated feed structure 206 and the coupling matrix 208. The transmission array structure 1100 is made up of conductive material formed on a dielectric layer 1212 sandwiched between layers 1208 and 1202. As described herein, the transmission array structure 1100 has a plurality of slots that correspond to a plurality of radiating elements in the radiating structure or lattice layer 1202.

Figure 13:
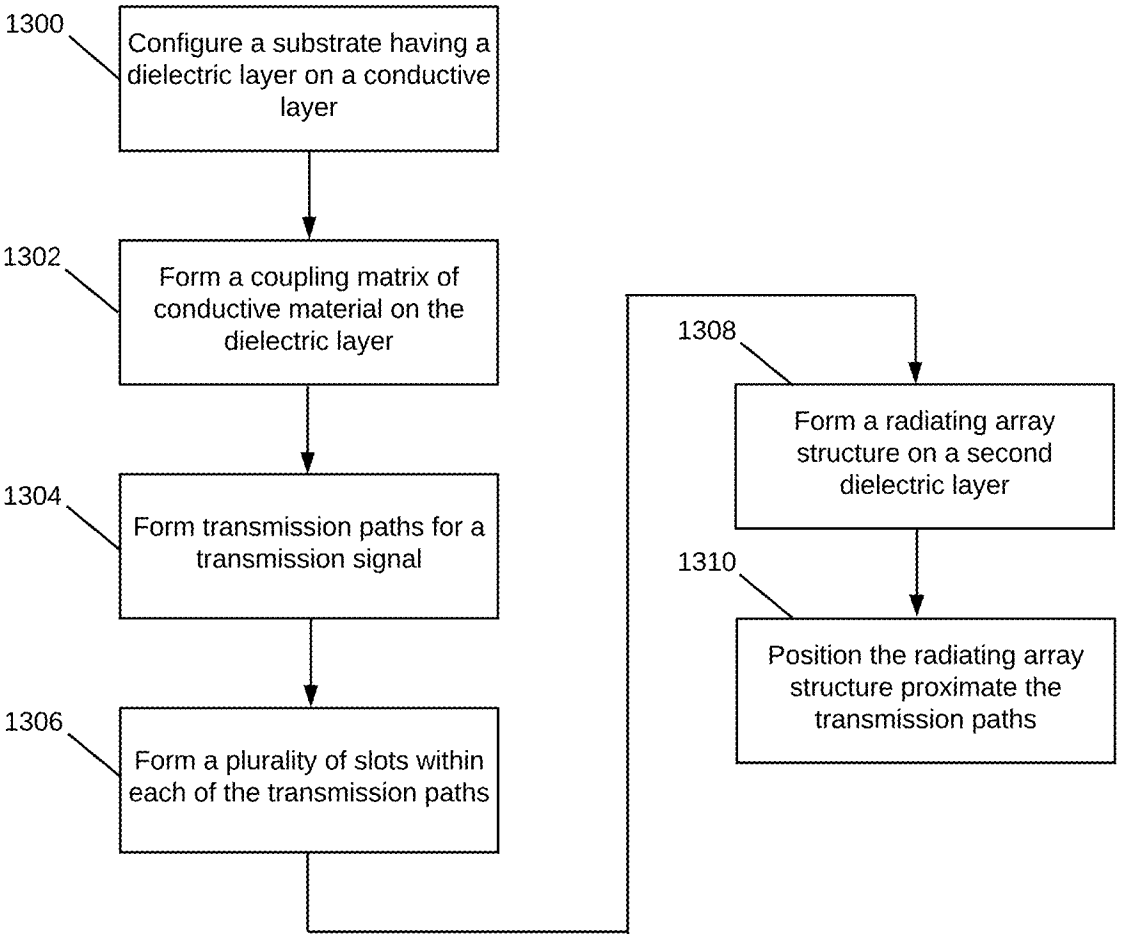
FIG. 13 is a flowchart for manufacturing a wireless transmission device having a radiating structure in accordance with various examples.

A flowchart for manufacturing a wireless transmission device with the radiating structure in FIG. 12 is shown in FIG. 13. First, a substrate is configured to have a dielectric layer on a conductive layer (1300). Next, a coupling matrix of conductive material is formed on the dielectric layer (1302). The coupling matrix is formed by placing vias through the dielectric layer to the conductive layer. The vias are lined with conductive material to form a conduit for a transmission signal to travel in the substrate. Once the coupling matrix is built, the transmission paths are formed (1304) and the slots are carved out within each of the transmission paths (1306). A radiating array structure is then formed on a second dielectric layer (1308) and positioned proximate the transmission paths (1310) to allow for a correspondence between each radiating element and a slot in a transmission path. As described above, the radiating array structure is a single or multi-layer array of radiating elements that can be designed as metamaterial elements with a desired shape and configuration to achieve a desired radiation pattern and performance.

The present inventions provide methods and apparatuses for radiating a signal, such as for radar or wireless communications, using an array of radiating elements and a transmission array and a feed structure. The feed structure distributes the transmission signal throughout the transmission array, wherein the transmission signal propagates along the rows of the transmission array and slots are positioned along each row. The slots are positioned to correspond to radiating elements of the lattice array. The radiating elements have a desired shape that is conducive to dense configurations optimizing the use of space and reducing the size of a conventional antenna.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein.

What is claimed is:

1. A wireless radiating structure, comprising:

a composite layer formed of a dielectric layer on a conductive layer, the dielectric layer having a feed coupling structure adapted to receive and propagate a transmission signal to a transmission array structure having a plurality of slots having a first size in a first row of slots and a second size in a second row of slots, wherein the first size is different from the second size; and a radiating array structure having a plurality of radiating elements, each radiating element of the plurality of radiating elements corresponding to one or more slots in the transmission array structure and each radiating element of the plurality of radiating elements comprising a hexagonal conductive patch and a hexagonal conductive outer loop, wherein the hexagonal conductive outer loop forms around the hexagonal conductive patch, and wherein the plurality of radiating elements comprising both the hexagonal conductive patch and the hexagonal conductive outer loop are formed in a densely packed array.

2. The wireless radiating structure of claim 1, wherein the radiating array structure is formed on a second dielectric layer positioned proximate the transmission array structure.

3. The wireless radiating structure of claim 1, wherein the radiating array structure comprises a multi-layer radiating array structure, wherein each layer of the multi-layer radiating array structure comprises an array of radiating elements.

4. The wireless radiating structure of claim 1, wherein each radiating element is a metamaterial radiating element, wherein a first metamaterial radiating element has a first shape, and wherein the first shape is defined by a first number of degrees of freedom with respect to edges of the first shape.

5. The wireless radiating structure of claim 1, wherein the wireless radiating structure is adapted to track a user device in a cellular system.

6. The wireless radiating structure of claim 1, wherein the transmission signal comprises a Frequency Modulated Continuous Wave (FMCW) sawtooth signal.

7. The wireless radiating structure of claim 1, wherein the hexagonal conductive patches in the plurality of radiating elements are identical.

8. A method for manufacturing a radiating structure, comprising:

configuring a substrate having a first dielectric layer on a conductive layer;

forming a coupling matrix of conductive material on the first dielectric layer;

forming a plurality of transmission paths on the first dielectric layer for propagation of a transmission signal;

forming a plurality of slots within each of the transmission paths, the plurality of slots having a first size in a first row of slots and a second size in a second row of slots, wherein the first size is different from the second size; and forming a radiating array structure on a second dielectric layer, the radiating array structure having a plurality of radiating elements corresponding to the plurality of slots to radiate the transmission signal, wherein each of the plurality of radiating elements comprises a hexagonal conductive patch and a hexagonal conductive outer loop, and is formed in a densely packed array, and wherein the hexagonal conductive outer loop surrounds the hexagonal conductive patch.

9. The method of claim 8, wherein the coupling matrix comprises a first set of vias through the first dielectric layer to the conductive layer to form a plurality of impedance-matched transmission lines.

10. The method of claim 8, wherein the transmission paths comprise a second set of vias through the first dielectric layer to the conductive layer.

11. The method of claim 8, wherein the transmission signal is a tapered transmission signal.

12. The method of claim 8, wherein the radiating array structure comprises a multi-layer radiating array structure, wherein each layer of the multi-layer radiating array structure comprises an array of radiating elements.

13. The method of claim 8, wherein each of the plurality of radiating elements is a metamaterial radiating element, wherein a first metamaterial radiating element has a first shape, and wherein the first shape is defined by a first number of degrees of freedom with respect to edges of the first shape.

14. The method of claim 8, wherein the hexagonal conductive patch has an elongated shape.

15. A wireless radiating structure, comprising:

a composite layer formed of a dielectric layer on a conductive layer, the dielectric layer having a feed coupling structure adapted to receive and propagate a transmission signal to a transmission array structure having a plurality of slots having a first size in a first row of slots and a second size in a second row of slots, wherein the first size is different from the second size; and a radiating array structure having a plurality of radiating elements, each radiating element corresponding to one or more slots in the transmission array structure, wherein each radiating element is a metamaterial radiating element having a conductive outer loop and a conductive patch circumscribed within the conductive outer loop, and wherein the plurality of radiating elements is formed in a densely packed array.

16. The wireless radiating structure of claim 15, wherein the radiating array structure is formed on a second dielectric layer positioned proximate the transmission array structure.

17. The wireless radiating structure of claim 15, wherein the radiating array structure comprises a multi-layer radiating array structure, wherein each layer of the multi-layer radiating array structure comprises an array of radiating elements.

18. The wireless radiating structure of claim 15, wherein each radiating element is a metamaterial radiating element, wherein a first metamaterial radiating element has a first shape, and wherein the first shape is defined by a first number of degrees of freedom with respect to edges of the first shape.

19. The wireless radiating structure of claim 15, wherein the transmission signal comprises a Frequency Modulated Continuous Wave (FMCW) sawtooth signal.

20. The wireless radiating structure of claim 15, wherein at least one of the conductive outer loops is shared by two adjacent radiating elements of the plurality of radiating elements.

* * * * *